US008821210B2

(12) United States Patent
Solotoff

(10) Patent No.: US 8,821,210 B2
(45) **Date of Patent: *Sep. 2, 2014**

(54) BRASSIERE WITH CUSTOMIZABLE VERTICAL LIFT

(76) Inventor: Brandon Solotoff, Nutley, NJ (US)

( * ) Notice: Subject to any disclaimer, the term of this patent is extended or adjusted under 35 U.S.C. 154(b) by 178 days.

This patent is subject to a terminal disclaimer.

(21) Appl. No.: 13/456,398

(22) Filed: Apr. 26, 2012

(65) Prior Publication Data

US 2012/0302135 A1 Nov. 29, 2012

Related U.S. Application Data

(63) Continuation-in-part of application No. 13/068,100, filed on May 2, 2011, now Pat. No. 8,668,549.

(60) Provisional application No. 61/518,168, filed on Apr. 29, 2011, provisional application No. 61/463,352, filed on Feb. 15, 2011.

(51) Int. Cl.
*A41C 3/00* (2006.01)

(52) U.S. Cl.
USPC ..... 450/63; 45/59; 45/60

(58) Field of Classification Search
CPC ..... A41C 3/0021; A41C 3/0028
USPC ..... 450/59–63
See application file for complete search history.

(56) References Cited

U.S. PATENT DOCUMENTS

| | | | | |
|---|---|---|---|---|
| 2,135,094 | A | 11/1938 | Alberts | |
| 2,175,676 | A * | 10/1939 | Walters | 450/63 |
| 2,421,448 | A * | 6/1947 | Witkower | 450/63 |
| 2,621,328 | A * | 12/1952 | Duchnofskey | 450/53 |
| 2,734,193 | A * | 2/1956 | Panes | 450/63 |
| 3,747,606 | A | 7/1973 | Tareau | |
| 4,632,118 | A | 12/1986 | Garutso | |
| 5,590,443 | A * | 1/1997 | Fildan | 24/200 |
| 6,422,917 | B1 | 7/2002 | Rose et al. | |
| 7,232,359 | B1 | 6/2007 | Richardson | |
| 7,452,260 | B2 * | 11/2008 | Redenius | 450/63 |
| 7,497,760 | B2 * | 3/2009 | Redenius | 450/60 |
| 7,607,966 | B1 | 10/2009 | Fox | |
| 7,677,951 | B2 * | 3/2010 | Redenius | 450/60 |
| 7,695,343 | B2 | 4/2010 | Nobbs | |
| 8,177,602 | B1 | 5/2012 | Kaytes | |
| 8,187,054 | B2 * | 5/2012 | Redenius | 450/59 |
| 2005/0277364 | A1 * | 12/2005 | Redenius | 450/41 |
| 2007/0232190 | A1 * | 10/2007 | Redenius | 450/41 |
| 2009/0031731 | A1 * | 2/2009 | Ziminsky et al. | 60/777 |
| 2010/0130098 | A1 | 5/2010 | Kammerer | |
| 2010/0210179 | A1 * | 8/2010 | Redenius | 450/63 |
| 2010/0317257 | A1 | 12/2010 | Campbell | |

* cited by examiner

*Primary Examiner* — Gloria Hale
(74) *Attorney, Agent, or Firm* — Thomas A. O'Rourke; Booner + O'Rourke, LLP

(57) ABSTRACT

An adjustable support brassiere comprises traditional bra elements—a bra band with closure; breast cups; and respective shoulder straps. Adjustability may comprise inner support cups having opposite ends being selectively attached on each breast cup, and a respective support strap being secured to each inner support cup, with a distal end of the support strap secured to an adjustment clip, which may releasably secure a portion of the shoulder strap. Adjustably securing different portions of the shoulder strap causes lifting and reconfiguring of the inner support cup to produce a desired amount of substantially vertical lifting to the woman's breast(s) in one embodiment, which is generally healthier for breast tissue than the typical inward displacement. Adjustments may be made by a woman throughout the day to alter her appearance as desired. Alternative embodiments permit lifting as well as inward/outward displacement, and may therefore serve as a minimizer.

28 Claims, 9 Drawing Sheets

40Ri
45A
45Ai
45Aii
210
211
80R
60R 45D
45C
45B
45A

40Rii
46B
46C
46A
221
220
224
222
223
80R
60R

40Riii
231
230

232

241
240

40Riv
40Riv
241
240
60R
80R 60R
251
250

51
55
50
53
54
52

3A, 3C, 3D, 3F
40L
118
32
5
22L
63L
26
40Lii
60L'
52
64L
61'
20L
80L
20Lo
20Li
21L
50L
51
30C
51
50R
21R
20Ri
20R
80R
20Ro
70
62
40R
40Rii
23
60
52
22R
61
25
63R
40R
31

BRASSIERE WITH CUSTOMIZABLE VERTICAL LIFT

CROSS REFERENCES TO RELATED APPLICATIONS

This application claims priority on U.S. Provisional Application Ser. No. 61/463,352 filed on Feb. 15, 2011 and U.S. Provisional Application Ser. No. 61/518,168, filed Apr. 29, 2011, and is a continuation-in-part of U.S. application Ser. No. 13/068,100, filed May 2, 2011, now issued as U.S. Pat. No. 8,668,549, having a common inventor, with the disclosures of each being incorporated herein by reference.

FIELD OF THE INVENTION

The present invention relates to improvements in brassieres, and more particularly to brassieres that provide adjustable support.

BACKGROUND OF THE INVENTION

Over the course of history, undergarments dedicated to providing support for, and/or for accentuating a woman's physique, particularly her breasts, have changed, in part, according to societal norms. It is well known that the Minoan women living on the Greek isle of Crete, around 2500 B.C., wore bra-like garments that served to lift their bare breasts out from their clothes. During the 1500s and later, corsets were worn, which tended to provide upward support for the wearer's breasts. In the latter part of the 1800s, the corset was split by some into a girdle for torso support and an upper device suspended from the shoulders for breast support. Such devices are found in various historic sources and reported in modern published accounts such as "Bra: A Thousand Years of Style, Support & Seduction," by Stephanie Pedersen.

During the late Victorian period in the United Kingdom, a "bust bodice," commonly referred to then as a "BB", was dedicated to providing basic shape and support for a woman's breasts by creating a mono-bosom effect, with examples being found today in English museums (see http://museums.leics.gov.uk/collections-on-line/GetObjectAction-.do?objectKey=103636). The bust bodice was essentially just a frilled, white cotton cloth that surrounded both breasts and was supported by a pair of straps, and fastened at the back by laces and/or a button.

Earliest use of the term "brassiere" in the United States is considered to be by the Syracuse Evening Herald in March 1893, in referring to a six-inch straight boned band being necessary for fashionable gowns at the time, while Vogue magazine used the term in 1907, and it was first adopted into the Oxford English Dictionary in 1911. However, first use of the term "Brassiere" in a patent was by Mary Jacob in the 1914 U.S. Pat. No. 1,115,674. But ironically, although she is often credited as inventing the first "modern bra," the device did not comprise cups for individual support of the wearer's breasts, and more closely resembled its progeny in the form of the bust bodice. Some tend to credit H. S. Lesher for his "Combined Breast Pads and Arm-Pit Shield" shown in the 1859 U.S. Pat. No. 24,033, as perhaps being the inventor of the bra, since part of its function is described as providing "a symmetrical rotundity to their breasts," Certain historians attribute Luman L. Chapman's 1863 U.S. Pat. No. 40,907 for an improved "Corset," as being the ""proto-brassiere." Olivia P. Flynt also received multiple U.S. patents for articles of clothing, and in 1876 received U.S. Pat. No. 173,611 for a "Bust Supporter", which states, among other things, that it "adapted to ladies having large breasts," that it "was specially designed as a bust support and improver" being designed for "producing a more comely outline and comfortable feeling than the corset," and that it "will be used instead of and take the place of the corset." Many others may justifiably attribute invention of the first modern bra to be the device that was patented and unveiled at the Exhibition of 1889 in France, by corset-maker Herminie Cadolle. She displayed her bra-like device-part of a two-piece corset, that was called Bien-être," meaning "Well-Being" (although it was initially called the "corselet gorge"), which was sold as a health aid. The first patenting within the U.S. of something closely resembling the modern bra was by Marie Tucek for her "Breast Supporter." The Tucek breast supporter received protection under the 1893 U.S. Pat. No. 494,397, and comprised a pair of cups that provided support through a pair of shoulder straps, and outwardly resembled the contemporary brassiere.

Today, a woman's bra functions not only to provide basic support, but also must fulfill ever increasing demands in terms of it being fashionable and shape-enhancing. One current demand is that the woman be able to use the bra to appear professional by daytime, which in some social circles or offices may entail appearing more conservatively, but once leaving the professional environment to enjoy late afternoon and early evening social events, the woman may desire to use the same bra to enhance her figure and appear more voluptuous, even seductively enhanced and suggestive, without having to change garments.

Although there are some prior art bras that function to enhance a women's bust line, such as the series of patents to Redenius (U.S. Pat. Nos. 7,452,260, 7,497,760, 7,645,179, and 7,677,951), each of these methods of enhancement undesirably causes inward rotation of the women's bust, which is detrimental to the health of the breast tissue. The brassiere invention disclosed herein permits a woman to achieve positive results, in which she may either tone down or accentuate her figure, but without the unhealthy consequences associated with the prior art.

OBJECTS OF THE INVENTION

It is an object of the invention to provide a bra that allows a woman to easily and conveniently adjust the support provided by the bra's cups.

It is another object of the invention to provide an adjustable bra that enhances the appearance of a woman's physique by permitting vertical adjustments to the lift being provided to her breasts.

It is a further object of the invention to provide a bra that provides a lift enhancing feature that may be adjusted while the woman is wearing the bra.

It is another object of the invention to provide a bra with an adjustable lift feature that provides vertical support, but without corresponding inward convergence for healthier support of the woman's breast tissue.

Further objects and advantages of the invention will become apparent from the following description and claims, and from the accompanying drawings.

SUMMARY OF THE INVENTION

The bra of the present invention has the ability to be adjusted to provide various degrees of lift in the vertical direction, to enhance the woman's figure in a healthier manner than is provided by prior art inward breast-displacing bra types, and uses a novel construction for the components therein.

The adjustable support brassiere may comprise a bra band; at least one breast cup being secured to a portion of the bra band; and a shoulder strap for each of the at least one breast cup, with the shoulder strap having a first end being secured to the bra band. An inner support cup for each of the at least one breast cup may have a first end and a second end being attached at a selective location on the respective breast cup. A portion proximate to the first end of the support strap may be secured to the inner support cup, with a second end of the support strap being secured to a support cup adjustment clip. A portion of the shoulder strap proximate to its second end may be releasably secured to the support cup adjustment clip, to permit substantially vertical adjustments of a selective portion of the inner support cup. These adjustments may serve to configure or reconfigure the inner support cup to be at a desired position.

Two different types of embodiments may be utilized for the support cup adjustment clip. In one embodiment, the clip may be the same as the typical shoulder strap-length adjustment clip utilized on many bras, which would permit generally continuous advancements of the strap to achieve lift. A second type of embodiment for the support cup adjustment clip may preferably permit incremental advancements, and may take several different forms, each of which may comprises a prong of some sort, while a portion of the shoulder strap may comprises two or more openings of some sort, so that the shoulder strap may be releasably secured to the support cup adjustment clip by having the prong being releasably received within one of the two or more openings. The openings may comprise fabric loops or eyelets, while the incremental support cup adjustment clip may comprises a hook member, a buckle, or a swan hook.

A first desired position may comprises a normal position at which a bottom of the inner support cup is coterminous with a bottom portion of the at least one breast cup. Adjustments may be made by releasing of the opening of the shoulder strap from the prong of the support cup adjustment clip, and causing movement of the shoulder strap relative to the support cup adjustment clip to secure another one of the openings using the prong, which may serve to cause reconfiguring of a portion of the inner support cup to be at a second desired position, which may comprise a vertically elevated position. With the inner support cup being stitched to the breast cup at its two ends, the reconfiguring instigated by the support strap may cause the inner support cup to be elevated vertically by having a portion between its first and second ends being elevated, possibly through elastic deformation of a stiffening member in the inner support cup, An elastic breast-cup support strap for each of the at least one breast cup may have a first end being secured to the support cup adjustment clip, and a second end being secured to a portion of the at least one breast cup to coordinate movement of a portion of the breast cup with the elevated movement of the inner support cup.

DETAILED DESCRIPTION OF THE INVENTION

Figure 1:
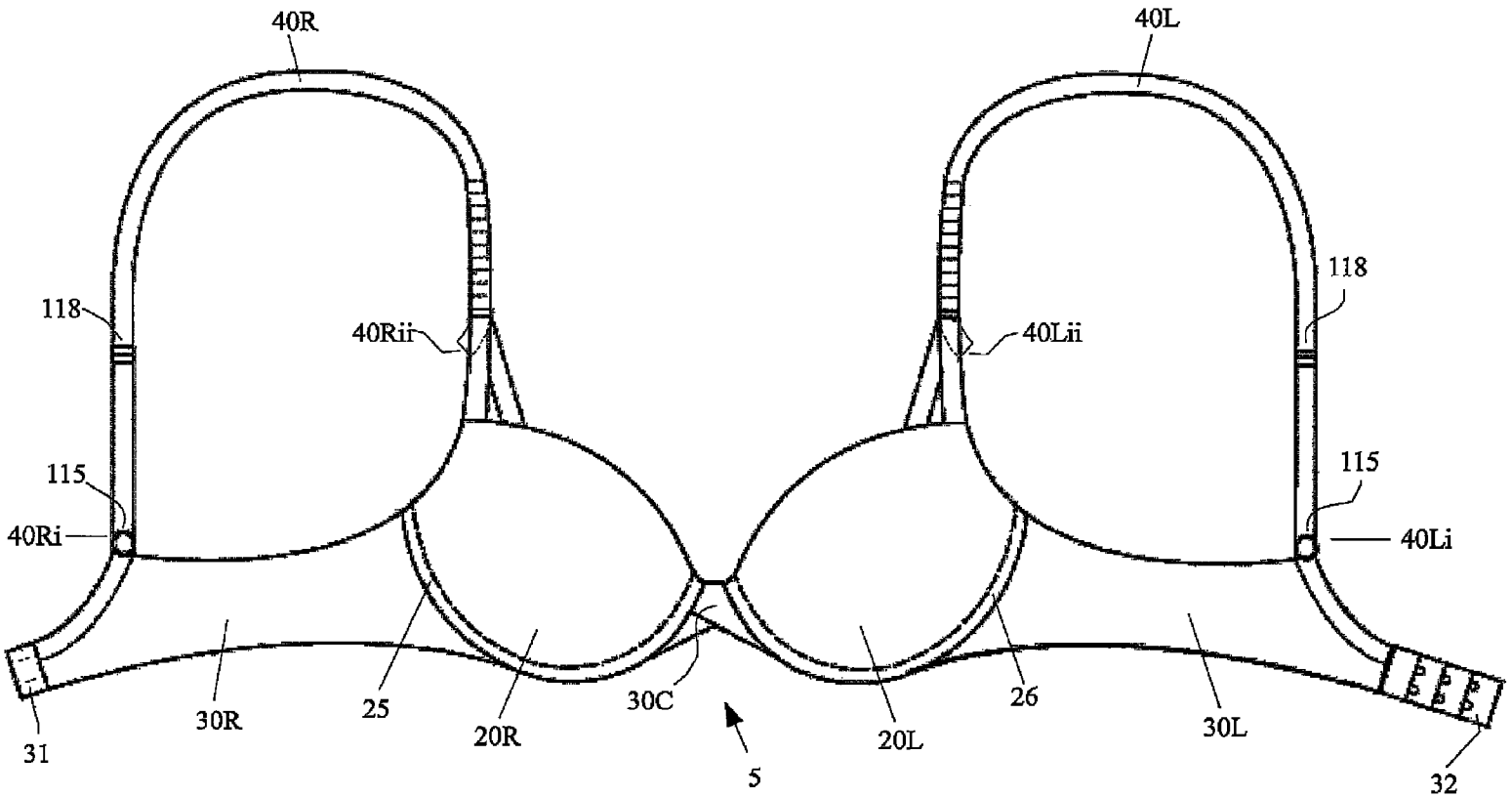
FIG. 1 generally shows a front view of a vertically adjustable support bra of the current invention.

The present invention relates to a bra, as well as teddies, corsets, breast feeding bras, minimizers, lingerie, bikinis, and the like, that may be adjustable to enable a wearer to easily and conveniently adjust the amount of lift provided, to be able it to transition quickly from a bra that provides a conservative appearance with requisite support amount/type, to a bra that enhances a woman's bustline. FIG. 1 shows a front view of the adjustable bra 5. The adjustable bra 5 may have certain portions constructed and assembled in the same way that a conventional bra is assembled. Adjustable bra 5 may have one or two breast cups, and may be comprised of a left breast cup 20L and a right breast cup 20R. The breast cups may be formed of a sturdy inelastic material, or may alternatively be constructed of an elastic material which still provides some support, but is nonetheless stretchable or elastically deformable to a certain degree. The bottom of each breast cup 20L and 20R may contain underwire 21 and 22, respectfully. Although the underwire 21 and 22 appears to be substantial in size within FIG. 1, its appearance therein may be overstated only to make the reader aware of its presence therein. The underwire may be small in size, and rather than being a "wire," it may instead be a thin, semi-circular strip of rigid material having a rectangular cross-section, so as to be flexible in conforming to, and resting against, the chest of the wearer, while still providing adequate stiffness in the vertical direction. This cross-sectional shape may serve to reduce the appearance of the "underwire" when the lifting components of the bra of the present invention are utilized. However, the invention may be successfully practiced without the use of an underwire being secured within the bottom of the breast cups.

Figure 1A:
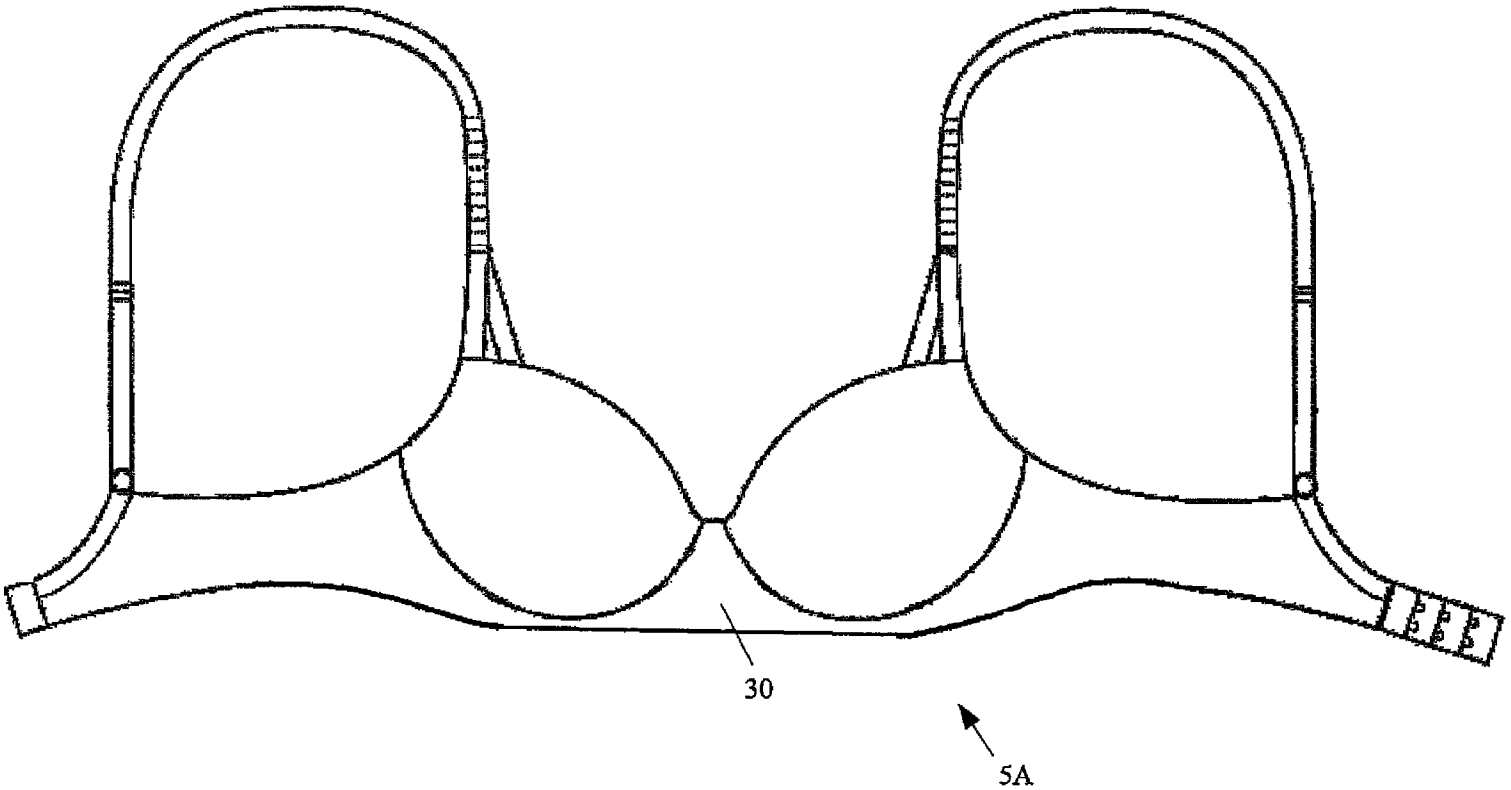
FIG. 1A shows an alternative embodiment of the bra of FIG. 1, having a continuous bra band.

The breast cups 20L and 20R may be properly spaced apart and situated to enclose a woman's breasts, by attachment, which may comprise stitching, to a portion of an encircling band—the bra band that is used to attach the bra about a women's torso. Adjustable bra 5 may comprise three distinct bra band segments, 30L, 30R and 30C, where the bra band 30L is attached to and extends away from the left breast cup 20L, the bra band 30R is attached to and extends away from the right breast cup 20R, and the bra band 30C is centrally attached to and extends in between both breasts cups, 20L and 20R. As seen for bra 5A in FIG. 1A, a single bra band 30 may alternatively be used in place of the multiple bra band segments.

The single bra band 30 may be continuous at the back of the wearer, so that the garment may resemble a pull-on type of bra, similar to many sports bras today. Where there is either the single bra band 30 or a segmented bra band, and where they are not integrally connected necessitating the pull-on method, a split in the band may be fastened together to secure the bra about the women's torso using a typical means of closure, such as a hook 31 and eye 32 joining system, or a button and button hole, etc. It is also common today for a bra to be constructed with a bra band 30C that may be continuous except for a split between the two cups where the split bra bands may be connected with a front closure means, such as the arrangement shown by U.S. Pat. No. 4,411,269 to Weintraub for "Front Opening Bra With Adjustable Back," the disclosures of which are incorporated herein by reference.

Figure 1B:
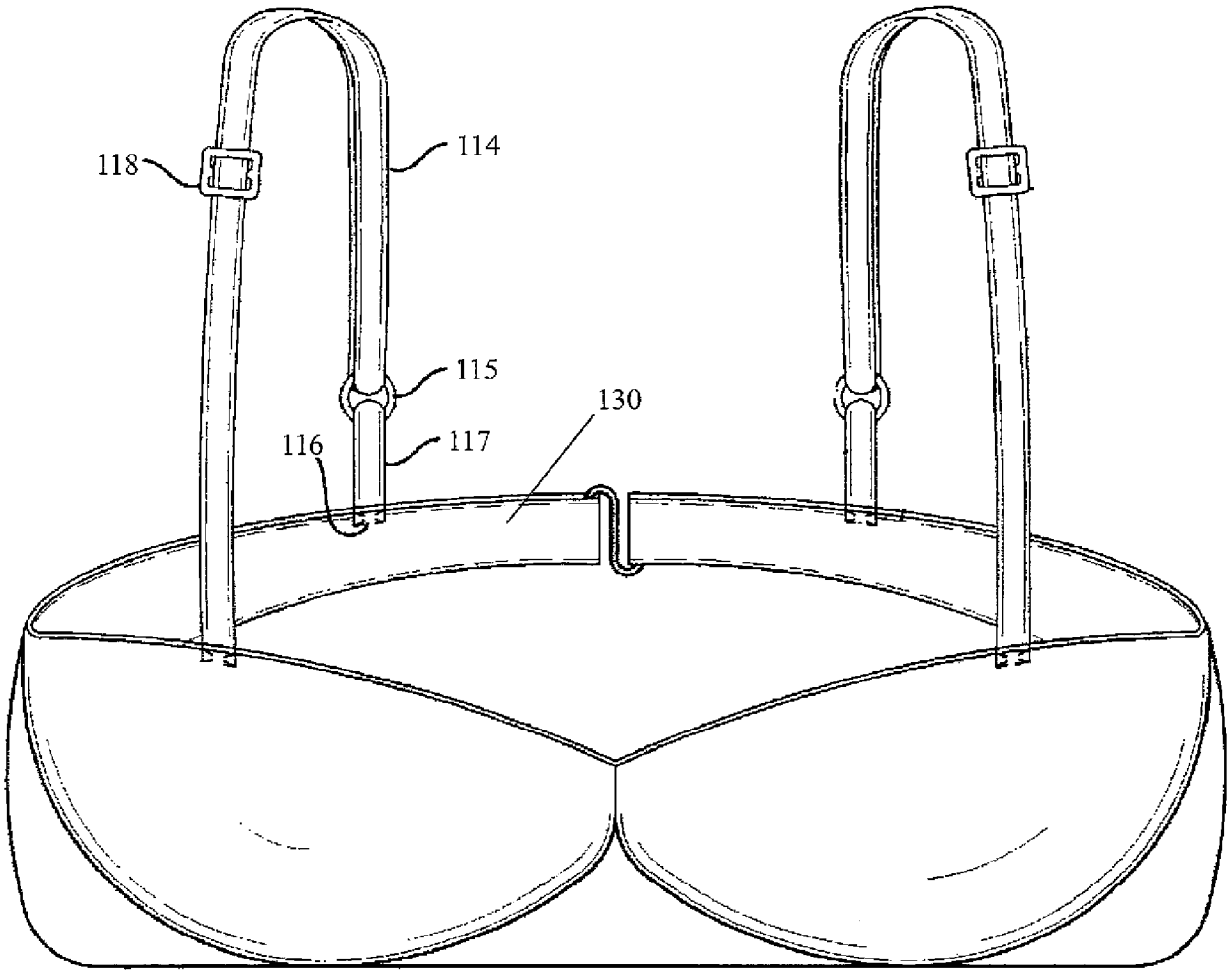
FIG. 1B (Prior Art)
FIG. 1B is a front view of a prior art bra, illustrating prior art attachment of the shoulder strap to the bra band.

The bra 5 of the present invention may have respective shoulder straps 40L and 40R, for each of the breast cups 20L and 20R. The shoulder straps 40L and 40R may have a first end, 40Li and 40Ri, respectively, which may be secured to a portion of the bra band in accordance with a conventional bra structural arrangement per the prior art bra illustrated in FIG. 1B herein, and as described in U.S. Pat. No. 6,186,861 to Flaherty, the disclosures of which are incorporated herein by reference. In FIG. 1B, a small strap portion 117 may loop about a ring 115 and have stitches 116 being used for stitching ends of strap portion 117 to the bra band 130. A main strap 114 may loop about ring 115 and utilize a conventional strap length adjustment clip 118 for adjusting the nominal length of the bra shoulder straps while the bra is being worn to provide the ordinary support that is required for regular, conservative use having an unenhanced appearance. Alternatively, as seen in FIG. 1 herein, a ring 115 may be stitched directly to a portion of bra bands 30R and 30L of bra 5, eliminating the need for strap 117 of the prior art.

A second end, 40Lii and 40Rii, of straps 40L and 40R may provide unique connectivity with breast cups 20L and 20R, and unique connectivity with specially constructed support structure located therein, to thereby be particularly operable to provide only substantially vertical lifting of the wearer's breast(s). The arrangement of those elements will be particularly directed to also permit spontaneous adjustments to the amount that the woman's breasts are lifted for enhancement of her figure.

Figures 2A, 3A, 3B, 3C, 3D, 3E, 3F, 3G, 3H, 4:
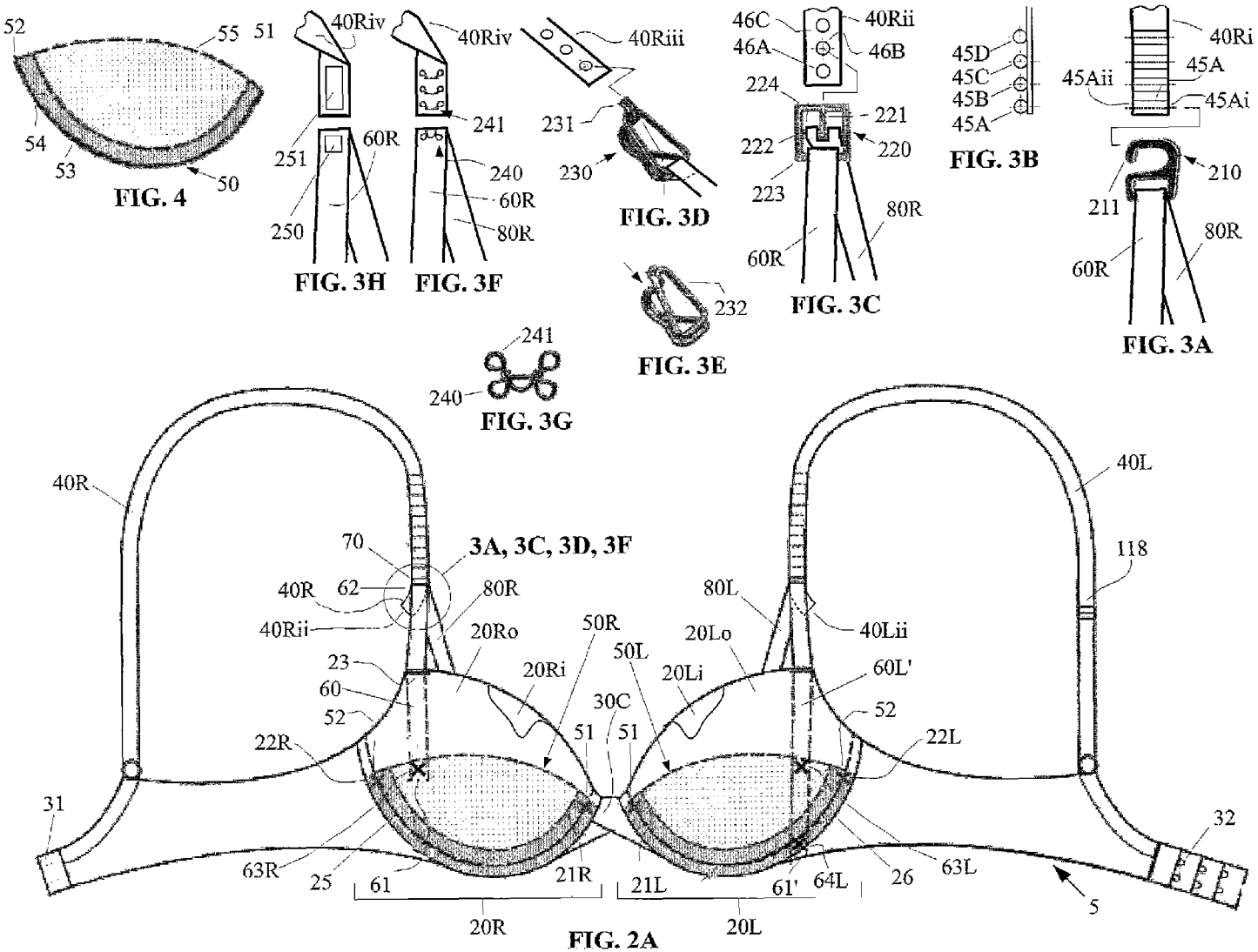
FIG. 2A is the front view detailing a first embodiment of the vertically adjustable support bra of FIG. 1, showing inner details of the bra's support capability, with the inner cup being in the unadjusted position.
FIG. 3A illustrates a hook member attached to the support strap and a series of looped opening in the bra shoulder strap, to permit vertical adjustment to the inner support cup.
FIG. 3B is a side view of the series of looped opening in the bra shoulder strap shown of FIG. 3A.
FIG. 3C illustrates a buckle member that may have the support strap attached thereto, to be connectable with a series of eyelets or openings in the bra shoulder strap, to permit vertical adjustment to the inner support cup.
FIG. 3D illustrates a swan hook member that may have the support strap attached thereto, with the hook portion of the swan hook member being receivable within one of a series of eyelets or openings in the bra shoulder strap, to permit vertical adjustment to the inner support cup.
FIG. 3E illustrates the swan hook member of FIG. 3D being shown by itself, and with the hook portion disengaged from the frame.
FIG. 3F illustrates a hook member that may be attached to the support strap, with the hook being releasably connectable to one of a series of catches attached to the bra shoulder strap (or vice versa), to permit vertical adjustment to the inner support cup.
FIG. 3G illustrates the hook and catch of FIG. 3E being shown by themselves and engaged with each other.
FIG. 3H illustrates Velcro being attached to the support strap and shoulder strap to thereby permit adjustments to the inner support cup.
FIG. 4 is a front view of the inner support cup.

FIG. 2A illustrates the bra components that may permit substantially vertical lifting. As seen in FIG. 2A, a support strap 60 may have a first end 61 that may be attached to an inner support cup 50, which may vary in size according to the size of the breasts cups, 20L and 20R. Inner support cup 50, also shown separately in FIG. 4, may have a first end 51 and a second end 52, and may be made of a flexible, though generally inelastic material. The inner support cup 50 may be shaped so as to normally have a curved bottom surface 53 nest close to the bottom portion of the breast cup, so as be normally conterminous therewith. The lower curved bottom 53 may normally retain such a complementary shape by incorporating a flexible stiffening member 54 with corresponding curvature, which may be secured to the material of the inner support cup. Where an underwire 21/22 is utilized for the breast cups, the curvature of the flexible stiffening member 54 may correspond to the curvature of the underwire. The flexible stiffening member 52 may be bonded to the material of the inner support cup 50, or the material of the inner support cup may be sewn to form a pocket with the stiffening member 52 being received therein, or flexible stiffening member may be attached using any other means known within the art for securing bra underwire. An upper curved edge boundary 55 of the inner support cup 50 may be generally curved so that in a front view of the cup, the inner support cup may appear to be elliptically shaped.

Figure 6:
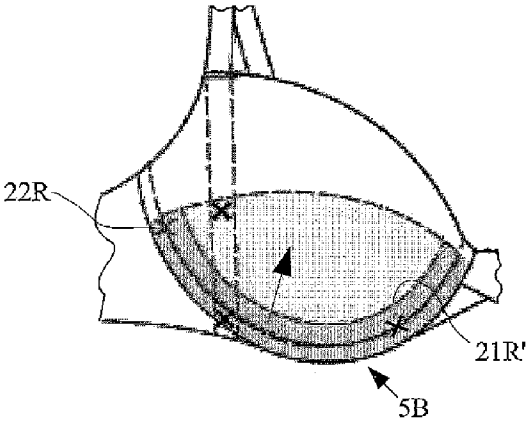
FIG. 6 is a second alternate embodiment showing the right breast cup and inner support cup of the bra of FIG. 2A, but having an inner support point 21R' positioned to provide both vertical lift and some inwardly directed lift.

The inner support cup 50 may be secured to the respective breast cup 20R/20L by attaching a portion proximate to the first and second ends, 51 and 52, of the inner support cup to the respective breast cups. Note that curvature may be slightly different—probably opposite—for the two breast cups, necessitating use of left-hand and right-hand inner support cups, 50R/50L. The first and second ends, 51, 52, for each of the inner support cups, 50R/50L, may be secured at points 21R/22R and 21L/22L using one of several different methods. One method is to stitch the inner support cup to the respective breast cup at those locations. The stitching may be concentrated at one particular point location, 21R/22R, and 21L/22L, marked by the "X" in FIG. 2A, to secure the inner support cup thereat, and may thus generally serve as a pivot location. Alternatively, a snap fastener may be used to pivotally secure the inner support cup to the breast cup, which may include, but is not limited to, the male and female snap members of expired U.S. Pat. No. 3,975,803 to Katayama, the disclosures of which are incorporated herein by reference. Any other suitable snap known in the art may also be used. Positioning of the points 21R/22R and 21L/22L for securing of the inner support cups 50R/50L relative to the respective breast cups 20R/20L affects the type of lifting that will result. To achieve substantially vertical lift, which is advantageous both for figure enhancement and for the women's breast tissue health, the points 21R and 22R will be positioned generally very close to same height above the lowest point of the cup. Where some amount of inward lift may also be desired, the outer support point 22R may be at a greater height than the inner support point 21R from the lowest point (see point 21R' for bra 5B in FIG. 6), and conversely, where some amount of outward lift is desired, the inner support point 21R may be at a greater height than the outer support point 22R. These characteristics will become evident from the ensuing paragraphs and the detailed descriptions relating to FIG. 5.

The support strap 60 may have a first end 61 that may be attached to inner support cup 50 through the use of stitching 63 (63R and 63 L for the left-hand and right-hand cups), and may be attached to an upper portion of the inner support cap that is proximate to the upper curved edge boundary 55. In one embodiment, the breast cups 20R and 20L may be formed with a secondary inner layer of material that may be in contact with the woman's breast, and thus the breast cups may constitute, where this embodiment is utilized, the outer/original layers 20Lo/20Ro and inner layers 20Li/20Ri that may respectively be stitched together at their periphery. For greater comfort to the wearer and to permit easier movement of the inner support cup, the inner layers 20Li/20Ri may comprise a smooth tricot liner. Where an embodiment with inner layers 20Li/20Ri is utilized, the stitching used to secure the inner layers may be interrupted in the region around the support strap 60 to create an opening 23, so that the strap may move freely relative to the breast cups 20L/20R.

The second end 62 of the support strap 60 may be secured to a support cup adjustment clip 70, which may releasably receive the second end 40Rii of the shoulder strap 40R to permit quick adjustment, at the woman's forward facing side, to the length of the shoulder strap to shorten the effective strap length. The support cup adjustment clip 70 may obviate the need for the strap length adjustment clip 118, which is not shown for the right shoulder strap 40R in FIG. 2A.

The support cup adjustment clip 70 may simply be the strap length adjustment clip 118 being utilized on the front side as shown, which would permit continuous advancement of the shoulder strap. Such advancement would cause the shoulder strap to be secured so as to shorten its effective length, which would be accompanied, because of its attachment to the inner support cup, by the inner cup essentially "reconfiguring" itself to be at a desired position, as seen, for example, in FIG. 5. The breast cups 20R and 20L may be formed of elastic material, and may be supported by a strap 80R/80L that has a first end 81 being attached to the top of the breast cup and a second end 82 being attached to the second end 62 of support strap 60 or being attached to the support cup adjustment clip 70. Strap 80R/80L may be generally inelastic, or alternatively, to lessen the amount of movement imparted to the top of the elastic breast cup, the strap 80R/80L may itself be elastic and may thus serve to absorb some of the movement resulting from adjustments to the shoulder strap. By not drawing the top of the breast cup upward in proportion to the adjustments made, a greater amount of the woman's breast may thus be exposed as part of the enhancement.

This "reconfiguring" of the inner support cup can take one or more of several different forms. In one form, the stitching, 21R/22R and 21L/22L, marked by the "X," to secure the inner support cup to the respective breast cup may be stitched using inelastic thread that is repeatedly stitched to rigidly connect the inner support cup at the those locations to the respective breast cups, to essentially form a pivot point.

Figure 5:
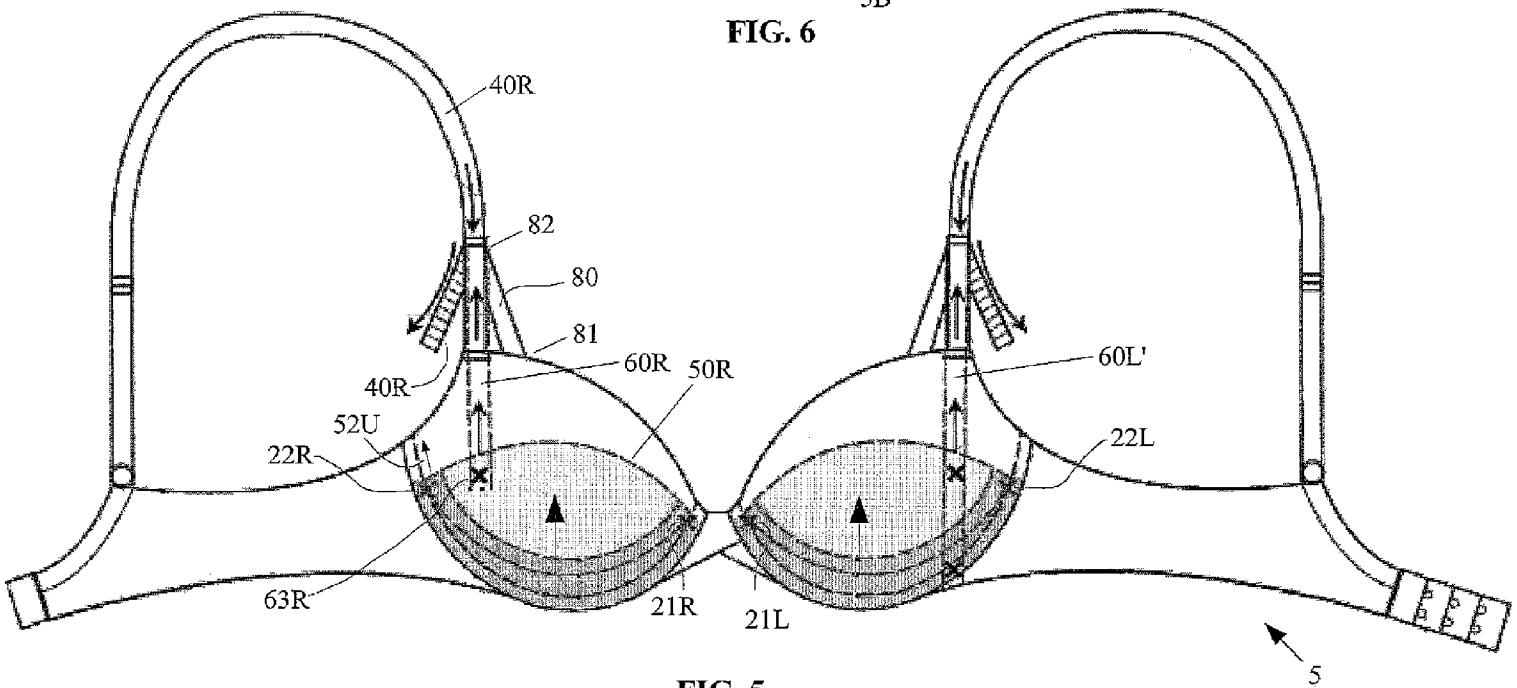
FIG. 5 is the front view of the vertically adjustable support bra of FIG. 2A, with the inner cup occupying one of several possible vertically-adjusted positions.

When the vertical force resulting from shortening of the shoulder strap is reacted by the stitched connection 63R with the inner support cup 50R, the curvature of the flexible stiffening member 54 of the inner support cup may no longer correspond to the curvature of the underwire, and may be elevated vertically. The vertical elevation may vary from being a zero amount of elevation at the stitched connection 63R, to being at a maximum amount of elevation at a lower central point of the inner support cup. The flexible stiffening member 54 may be a rubberized member that may independently accommodate such deformation to result in the reconfiguring of the inner support cup, as seen in FIG. 5, without affecting the shape and positioning of the breast cup underwire and periphery. Where a flexible stiffening member 54 may be made of a stiffer plastic material, its reaction to the loading from the support strap may not necessarily accommodate such deformation independently to reconfigure the inner support cup, and it may affect the shape of the breast cup underwire and periphery by, for example, causing a slight increase to breast cup underwire's radius of curvature.

Alternatively, where a flexible stiffening member 54 may be made of the stiffer plastic material, its reaction to the loading from the support strap may nonetheless accommodate such deformation independently to reconfigure the inner support cup, through the use of elastic threading being used at the stitching locations, 21R/22R and 21L/22L. Such elastic threading may provide a soft attachment point that may permit some upward movement to the ends of the flexible stiffening member 54, as illustrated by the arrow 52U in FIG. 5, in addition to some pivotal movement.

Each of these deformation types for the inner support cup may result in substantially vertical elevation to the wearer's breast, rather than causing the inward displacement of the breast typical of prior art breast positioning brassieres, which is generally not healthy for a woman's breast tissue, when the points 21R and 22R are positioned generally very close to same height above the lowest point of the cup. Subsequent adjustments may be made to the shoulder strap herein to cause additional elevation of the woman's breast to further accentuate the curviness of her figure, and similarly, the adjustments may be undone to restore the inner support cup to its normal position, with the curved bottom surface 53 again nesting close to the bottom portion of the breast cup underwire. Restoration may occur by releasing of the shoulder strap to increase its effective length. Return of the inner support cup to its normal, nested position in the breast cup may be achieved solely through the stiffness of the flexible stiffening member 54 elastically returning to an un-deformed condition after removal of the load from the support strap 60, which may be adequate where the member is made of the stiffer plastic material. It may be understood from viewing FIG. 5, that where the support point locations 21R/22R and 21L/22L are varied, other than substantially vertical lift may result. For example, where the inner support point 21R may instead be at a position closer to the lowest point on the cup (nearer the cup's center, as of point 21' in FIG. 6), the upward directed force on the inner support cup by the support strap 60 would tend to have both a vertical component of lift, but also an inward component of lift.

Return of the of the inner support cup to its normal, nested position may also be achieved by using a strap 60L' in which the strap extends downward (FIG. 2A) to have a first end 61' be stitched using stitches 64L to a bottom portion of the breast cup being proximate to the underwire 25/26, while stitches 63L may secure the strap 60L' to the top portion of the inner support cup. In this embodiment, the region of the strap 60L' from its first end 61' and extending slightly beyond stitching 63L may preferably be a somewhat loose elastic material, to provide a restoring force for when the inner support cup is elevated vertically, while the remainder of the strap 6012 may preferably be generally inelastic, to be better able to transmit the force to cause the vertical elevation of the inner support cup.

To better assist the wearer of the bra in making vertical adjustments to the inner support cup to accentuate her figure, the support cup adjustment clip 70 may comprise a member that may accommodate incremental adjustments, rather than the continuous advancement provided by the strap length adjustment clip 118. This incremental adjustability may also assist the wearer in quickly restoring the bra back to its normal condition. Several alternatives for a support cup adjustment clip 70 permitting such incremental adjustment may comprise incorporating therein a "prong" that may be received in one or more openings in the shoulder strap 40L/40R. These alternatives are illustrated in FIGS. 3A through 3G.

In FIG. 3A, the "prong" may comprise a portion of the hook member 210 protruding laterally and then downward to form a hook 211. Hook member 210 resembles a type of clasp that is often used as a center-front bra closure means. The corresponding shoulder strap 40Ri may have two or more loops that may be integral thereto or be stitched onto a portion proximate to its second end, forming a series of loops, 45A, 45B, 45C, 45D, etc. The normal position for the inner support cup 50 of the bra S may be with the hook 211 of hook member 210 releasably received through end opening 45Ai of loop 45A and exiting out from end opening 45Aii. Reconfiguring of the inner support cup to a vertically elevated position may occur by releasing/removing the hook 211 from the loop 45A and inserting it into loop 45B. Additional reconfiguring may occur by movement of the hook 211 of hook member 210 from loop 45B to loop 45C, or loop 45D, or other loops where they may be provided.

A sufficient number of loops may be provided according to a predictable amount of total elevation that may be expected to be desired for a certain cup size, along with adequate loop spacing to provide for a desired incremental amount of loop-to-loop adjustment, which may be in the range of approximately $\frac{1}{8}^{th}$ of an inch to approximately ½ of an inch. The second end 62 of support strap 60 may be attached to a circumferential portion of the hook member 210, while the breast cup support strap 80 may similarly be attached, or it may be stitched to the support strap 60, or alternatively, the support strap 60 and breast cup support strap 80 may comprise a single strap which may pass through the circumferential opening in hook member 210.

In FIG. 3C, the "prong" may comprise a pivotal prong 221 of the buckle member 220, being pivotal about a center bar 222 that is supported by frame 223. The second end 62 of support strap 60 may be attached to a portion of the frame 223, while the breast cup support strap 80 may be attached as previously described, or may be attached to the center bar 222 as illustrated. The corresponding shoulder strap 40Rii may have two or more openings that form a series of openings, 46A, 46B, 46C, etc. To be more durable the openings may comprise eyelets, according to U.S. Pat. No. 4,890,362 to Odajima for "Eyelet and Method of Attaching the Same," the disclosures of which are incorporated herein by reference. One of the eyelet openings may be releasably received by the prong to provide the aforementioned normal position or the amount of vertical elevation.

In FIG. 3D, the "prong" may comprise a hook portion 231 of the swan hook member 230 that may be secured relative to a frame 232. The second end 62 of support strap 60 may be attached to a portion of the frame 232, while the breast cup support strap 80 may be attached as previously described. The corresponding shoulder strap 40Riii may have two or more openings/eyelets, 46A, 46B, 46C, etc., as previously described. One of the eyelet openings of shoulder strap 40Riii may be releasably received by the hook portion of the swan hook. Releasing the hook portion 231 from the frame 232, as seen in FIG. 3E, permits the eyelet opening of the shoulder strap to be removed from the hook portion and allows the shoulder strap to be fed through the frame (see FIG. 3D), so that another eyelet may be received by the hook to provide the aforementioned vertical elevation.

In FIG. 3F, another embodiment is shown that does not make use of a "prong" per se, and may utilize a traditional rear bra hook member 240 that may be stitched to the second end 62 of support strap 60, while multiple copies of the corresponding catch 241 may be secured to the shoulder strap 40Riv. The breast cup support strap 80 may be attached as previously described. Mating of the hook member 240 and catch 241 is illustrated in FIG. 3G. Releasing the hook member 240 from one of the catches 241 permits another catch on the shoulder strap to be received by the hook member to provide the aforementioned vertical elevation.

In FIG. 3G, another embodiment is shown that also does not use a prong, and instead may utilize hook and loop fabric pieces 250/251, otherwise known as Velcro. One piece, 250, may be sewn or bonded to the second end 62 of support strap 60R, while the other piece, 251, may be secured to the shoulder strap 40Riv. There may instead be a series, of smaller pieces (251*a*, 251*b*, 251*c*, . . . ) on the shoulder strap 40Riv. The use of Velcro permits any custom incremental change to the strap, which may be desirable for smaller breast sizes.

To better conceal the support strap 60 and the inner support cups 50L/50R, the breast cups 20L and 20R may also include a thick layer of padding, which may be a elastic or an inelastic material. The separate padding layer may be added between the breast cup inner and outer layers 20Lo/20Ro and 20Li/20Ri.

Figure 2B:
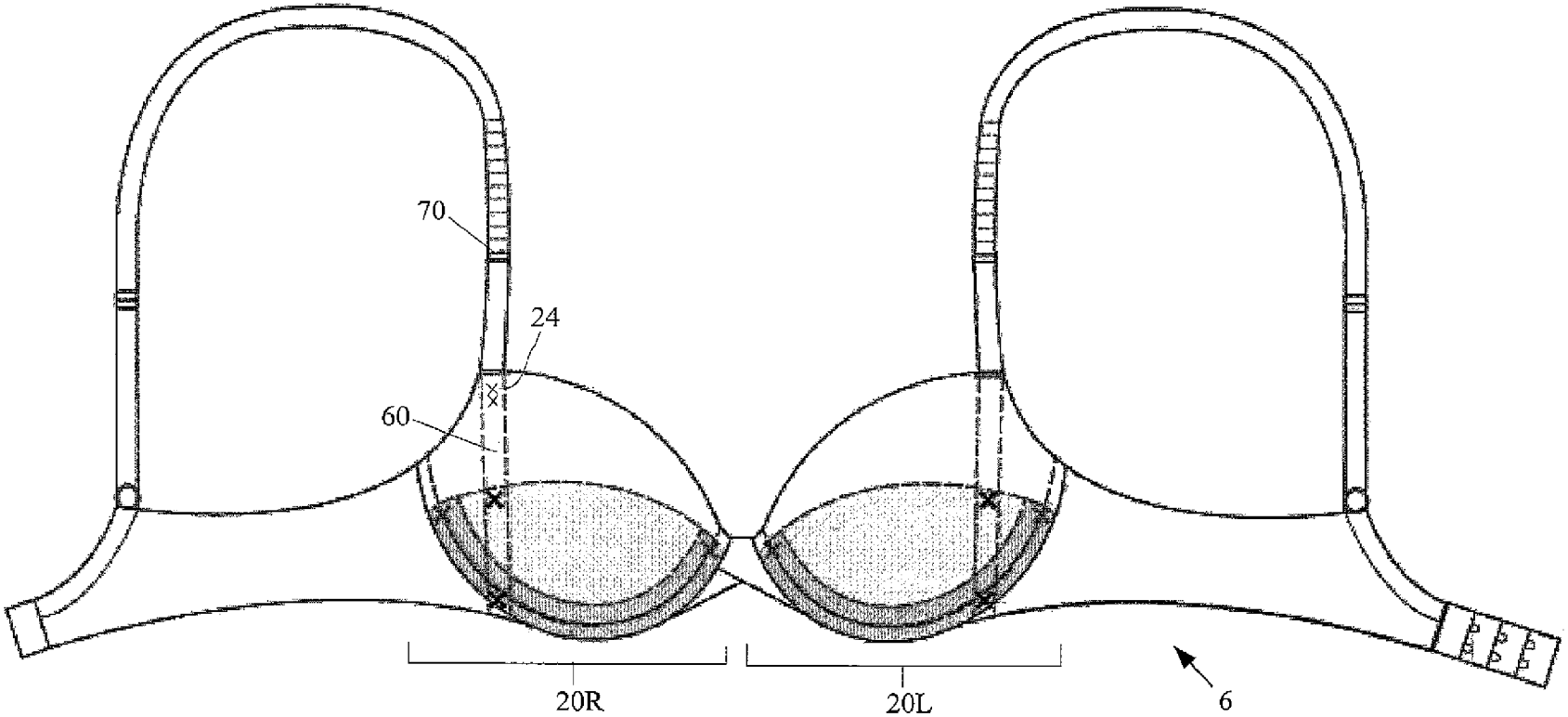
FIG. 2B is the front view illustrating a first alternate embodiment of the vertically adjustable support bra of FIG. 1, showing inner details of the bra's support capability, with the inner cup being in the unadjusted position.

A first alternative embodiment of bra 5 of the present invention is bra 6, which is illustrated in FIG. 2B, which omits the breast cup support strap 80. Support for the upper portion of the breast cups may instead be provided by one or more running stitches 24 that may be loosely applied using elastic threading. So, upward movement of the support strap 60 is generally, though not directly, transmitted to the upper portion of the breast cups 20L/20R.

Figure 7A:
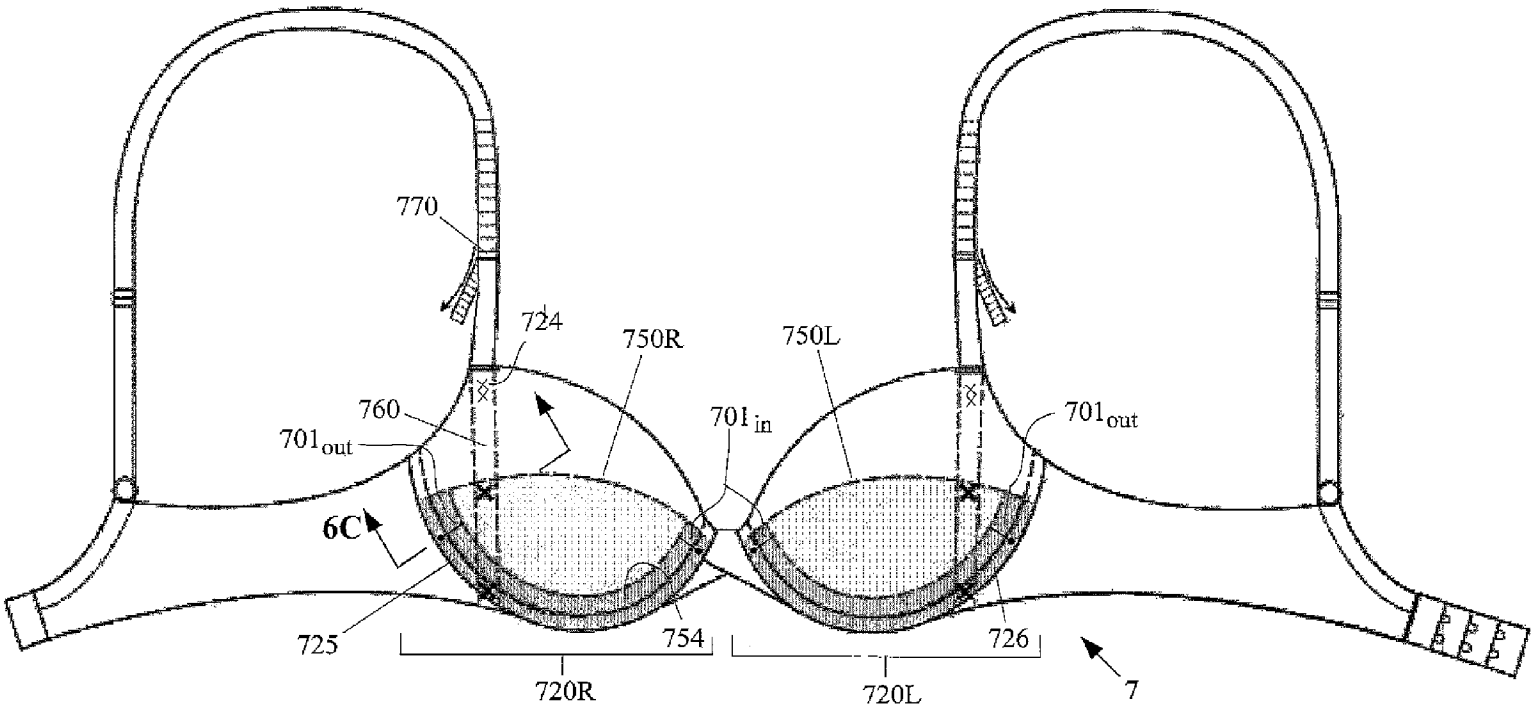
FIG. 7A is a third alternate embodiment of the bra of the current invention, which utilizes an inner support cup adapted for sliding relative to the bra underwire, with the inner support cup being in the unadjusted position.

A second alternative embodiment of the current invention is shown by bra 7, which is illustrated in FIG. 7A. Bra 7 may have left and right breast cups 720L/720R each having a respective inner support cup 750R/750L, which may have one or more particular connections with the bra underwire 725/726 of each cup to permit sliding relative to the underwire. The sliding arrangement may be accommodated by a pin 701 that has a shank portion 702 that may be rigid and may furthermore be secured to the stiffening member 754 of the inner support cup, with a manufactured head portion 703 being cantilevered out from the stiffening member to be displaced a short distance therefrom. The shank portion may be secured to the stiffening member using an appropriate adhesive, as seen in FIG. 7C, or by deforming (or upsetting) the end of the pin opposite the head in a fashion similar to a rivet with have a bucked head 70211 bearing against the upper side of the stiffening member (FIG. 7D).

Figure 7E:
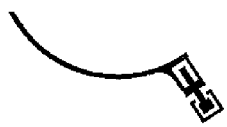
FIG. 7E is the cross-sectional view of FIG. 7C, but where the pin has a manufactured head that comprises a block shape instead of a spherical shape.
Figure 7D:
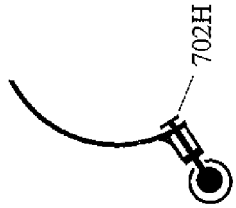
FIG. 7D is the cross-sectional view of FIG. 7C, but with the pin also having a bucked head for securing the pin to the curved stiffening member of the inner support cup.
Figure 7C:
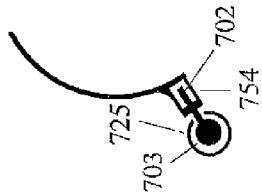
FIG. 7C is an enlarged cross-sectional view through the pin and underwire of the bra of FIG. 7A.
Figure 7B:
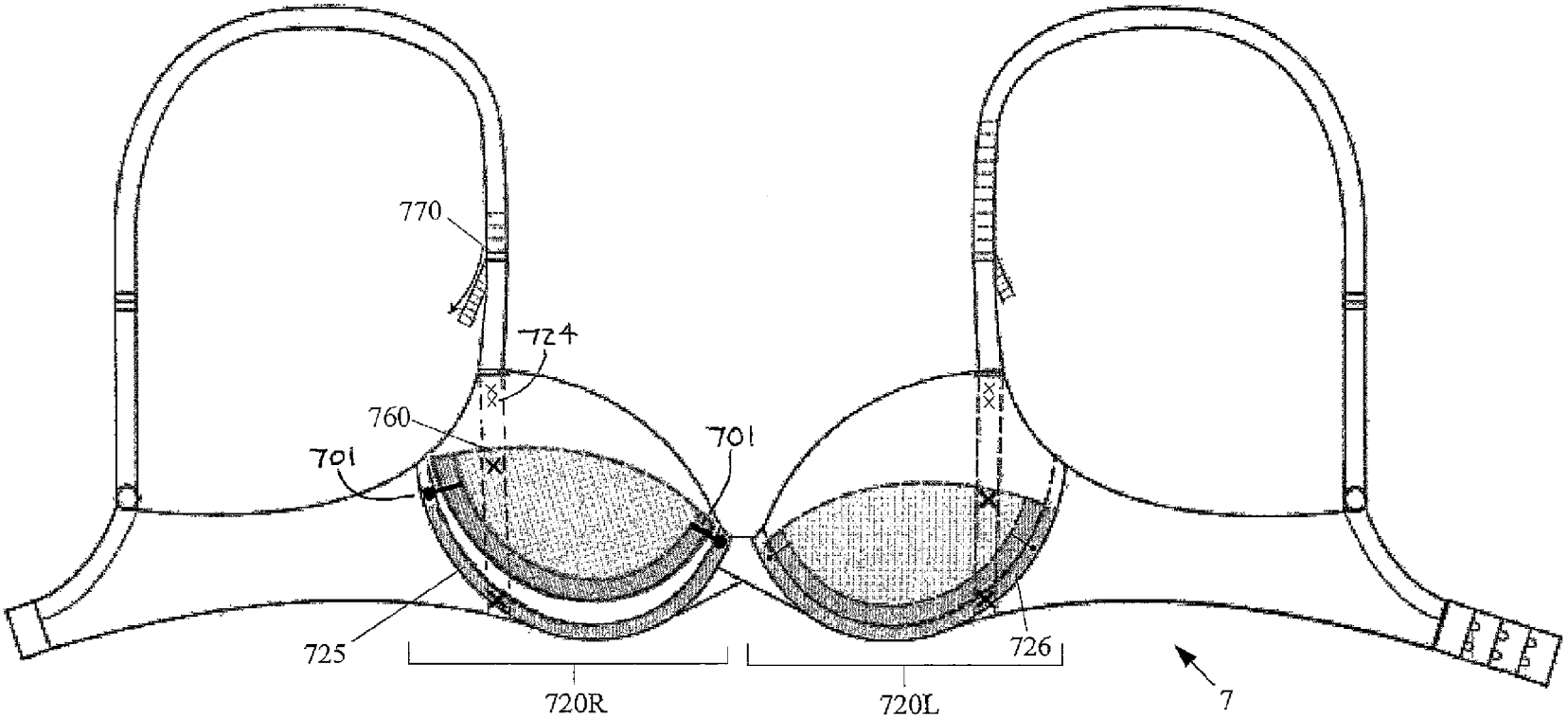
FIG. 7B is the alternate embodiment of FIG. 7A, shown with the inner cup occupying one of several possible vertically-adjusted positions.

This arrangement is shown enlarged in FIGS. 7C and 7D, with the head portion being spherical, and in FIG. 7E with the head portion comprising a rectangular block with rounded edges and corners. The spherical head portion 703 may be slidably received within a hollow portion of the bra underwire, which may, but need not, extend for the entire length of the underwire 725/726. As seen in FIG. 7A, each inner support cup 750R/750L may have the shank of two pins 701 secured to its stiffening member, with the shank of the pins being respectively secured proximate to, or generally near to, each end of the cup. When the support strap 760 is adjusted upwardly using one of the previously described support cup adjustment clips 770, the inner support cup may elevate as seen for the right-side cup 720R in FIG. 7B, by having the head portion 703 (spherical or block) of each of the pins 701 track (slide) within the hollow portion of the underwire 725. Due to the corresponding curvature of both the underwire 725/726 and the stiffening member 754 of the inner support cups, elevating the inner support cups to be displaced from the underwire as shown, may require some deformation of the underwire and/or some deformation of the stiffening member, which may be acceptable. Where such deformation is not acceptable, the shank portion 702 of the pin 701, rather than being a single rigid member, may instead be adapted to telescope outward under such loading, or it may alternatively be made of an elastic material that may elongate to accommodate some separation between the stiffening member 754 and the underwire 725/726.

It is important to note that because of the positioning of the pins 701 on the inner support cup 750R, and with the location of the attachment of the support strap 760 to the inner support cup being closer to the pin at the outside end, there will be a natural tendency toward having more translation achieved by the outer pin 701 for a given support strap adjustment than by the inner pin 701. This may result in not only vertical lift, but some inwardly directed lift as well. This may be adjusted by moving the outer pin location downward to be more centrally located. It may also be adjusted by utilizing a different coefficient of elasticity for the shank portion of the outer pin than for the shank portion of the inner pin, allowing for differential elongation between the two sides. A stiffer elastic shank portion for one of the outer pins may serve to keep it in closer contact with the underwire causing more friction, which may thereby serve to resist motion by the outer pin, and allow more equal tracking motion by the two pins, resulting in substantially vertical lifting.

It should also be noted that in this embodiment, either the outer pin 701 or the inner pin 701 may also be positioned close to the end of the hollow track in the underwire so that after a short amount of tracking (or even no tracking at all) adjustment of the support strap 760 upwardly may cause pivoting about that end. Depending upon which pin 701 was located close to, or at, the end of the underwire track (the inside pin or the outside pin), pivoting may respectively produce upward and inward lifting or upward and outward lifting. For example, if the outer pin $\mathbf{701}_{out}$ for the left breast cup 720L in FIG. 7A is initially positioned at the end of the track within underwire 726, it would serve as a pivot point, so that adjustment of the support strap 760 upwardly would cause pivoting about pin $\mathbf{701}_{out}$ and tracking/elongation for the pin $\mathbf{701}_{in}$.

Figure 8:
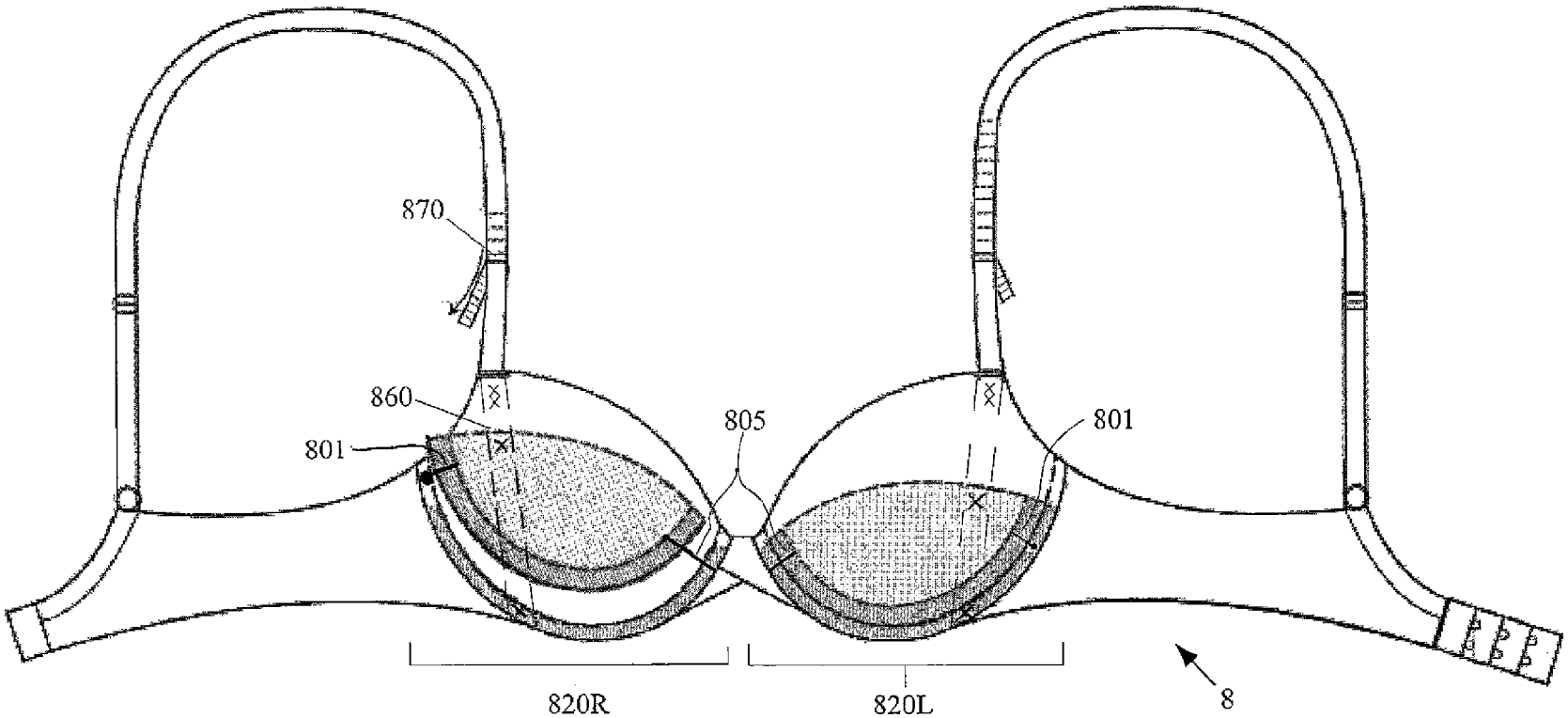
FIG. 8 is a fourth alternate embodiment of the bra of the current invention, which utilizes an inner support cup adapted at a first end for sliding relative to the bra underwire and adapted at a second end for translation that overcomes elastic biasing, with the inner support cup being shown in the unadjusted position for the left-side cup and in the outward/vertical adjusted position for the right-side cup.

A third alternative embodiment of the current invention is shown by bra 8, which is illustrated in FIG. 8. Bra 8 may also have left and right breast cups 720L/720R with each having a respective inner support cup 750R/750L, which may have specific connections with the bra underwire 725/726 of each cup that permits sliding relative to the underwire for only one side of the inner support cup. This may be accomplished by having a pin 801, as previously described for bra 7 (pin 701), for one end of the inner support cup, and by having only an elastic connection 805 between the inner support cup and the underwire for the other end of the inner support cup. As seen for the right breast cup 820R, adjustment of the support strap 760 upwardly would cause tracking by the pin 801 at the outer end of the inner support cup and translation (elongation of 805) for the inner end pin of the support cup. This arrangement serves to provide more outwardly directed lifting. Also, in this embodiment the support strap 860 may preferably further enable such outward lifting by attaching to the breast cup at the underwire to be at a more central position.

These bra embodiments that provide the above-described customizable lift may be utilized differently from one side to the other (left and right), and may thus be used to correct the differences in size of a woman's beasts. In addition, they may function very well in lifting and redistributing breast tissue independently from side to side to thereby more advantageously serve as a minimizer bra, which may universally tailor the breast tissue distribution differently for each side, instead of requiring a uniquely created bra for each female customer who has her own unique physique.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

I claim:

1. A brassiere comprising:

a bra band;

at least one breast cup being secured to a portion of said bra band;

a shoulder strap for each of said at least one breast cup; said shoulder strap having a first end being secured to said bra band;

an inner cup for each of said at least one breast cup, said inner cup having a first end and a second end, with each being respectively attached at a first and second selective location on said at least one breast cup;

an adjustment clip;

an inner cup support strap, a portion of said inner cup support strap being secured to said inner cup, and a second end of said inner cup support strap being secured to said adjustment clip; and wherein a portion of said shoulder strap proximate to its second end is configured to releasably secure a portion of said adjustment clip thereto, to permit at least a selective portion of said inner cup to occupy a desired position from among two or more positions, to permit lift adjustment of a wearer's breast therein.

2. The brassiere according to claim 1, wherein said adjustment clip comprises a prong, and said portion of said shoulder strap proximate to said second end of said shoulder strap comprises two or more openings; and wherein said shoulder strap being releasably secured to said adjustment clip comprises said prong being releasably received within one of said two or more openings.

3. The brassiere according to claim 2, wherein a first one of said one or more desired positions comprises a normal position at which a bottom of said inner cup is coterminous with a bottom portion of said at least one breast cup.

4. The brassiere according to claim 3, wherein a second one of said one or more desired positions comprises a first elevated position of said inner cup where said prong is received in a second one of said two or more openings.

5. The brassiere according to claim 4, wherein said first and second selective locations for said respective attachment of said first and second ends of said inner cup comprise said first and second locations being at substantially the same vertical distance above a lowest point on said at least one breast cup, to provide for substantially vertical lift adjustments with said prong and said two or more openings.

6. The brassiere according to claim 5, wherein said inner cup comprises a curved support member secured to said bottom of said inner cup, said curved support member configured to be flexible to deform between said first and second ends of said inner cup.

7. The brassiere according to claim 6, wherein said respective attachment of said first and second ends of said inner cup to said first and second selective locations on said at least one breast cup comprises attachment with elastic thread.

8. The brassiere according to claim 6, further comprising an underwire secured to said bottom portion of said at least one breast cup, said underwire configured to be flexible to deform in response to said deformation of said curved support member of said inner cup.

9. The brassiere according to claim 8 further comprising an elastic breast-cup support strap for each of said at least one breast cup, said breast cup support strap having a first end being secured to said adjustment clip, and a second end being secured to a top portion of said at least one breast cup.

10. The brassiere according to claim 9 wherein said portion of said inner cup support strap being secured to said inner cup comprises said portion of said inner cup support strap being stitched to a top portion of said inner cup.

11. The brassiere according to claim 10 further comprising a first end of said inner cup support strap being secured to a bottom portion of said at least one breast cup.

12. The brassiere according to claim 11 wherein a portion of said inner cup support strap is stitched to a top portion of said inner cup.

13. The brassiere according to claim 12 wherein at least a portion of said inner cup support strap comprises elastic material, said elastic material being located between said stitching at said first end of said inner cup support strap and said securement stitching at said top portion of said inner cup.

14. The brassiere according to claim 13 wherein said respective attachment of said first and second ends of said inner cup to said first and second selective locations on said at least one breast cup comprises a means of providing a pivotal attachment.

15. The brassiere according to claim 14 wherein said at least one breast cup comprises stretchable material.

16. The brassiere according to claim 2 wherein said openings comprise fabric loops.

17. The brassiere according to claim 2 wherein said prong comprises a hook member.

18. The brassiere according to claim 2 wherein said openings comprise eyelets.

19. The brassiere according to claim 2 wherein said prong and said adjustment clip form a buckle.

20. The brassiere according to claim 2 wherein said prong and said adjustment clip form a swan hook.

21. A brassiere comprising:

a bra band;

at least one breast cup being secured to said bra band;

a shoulder strap for each of said at least one breast cup; said shoulder strap having a first end being secured to said bra band;

an inner cup for each of said at least one breast cup, said inner cup having a first end and a second end, with each being respectively attached at a first and second selective location on said at least one breast cup;

an inner cup support strap for each of said at least one breast cup, a portion of said inner cup support strap being secured to said inner cup; and means for releasably securing a second end of said inner cup support strap to a portion of said shoulder strap proximate to a second end of said shoulder strap, to thereat occupy a desired position from among two or more positions, to permit vertical adjustments of a selective portion of said inner cup, to permit lift adjustment of a wearer's breast therein.

22. The brassiere according to claim 21 wherein said first and second selective locations for said respective attachment of said first and second ends of said inner cup comprise said first and second locations being at substantially the same vertical distance above a lowest point on said at least one breast cup, to provide for substantially vertical lift adjustments with said prong and said two or more openings.

23. A brassiere comprising:

a bra band;

at least one breast cup being secured to said bra band; each of said at least one breast cup comprising an underwire secured to a bottom portion of said breast cup; said underwire having a first end and a second end;

a shoulder strap for each of said at least one breast cup; said shoulder strap having a first end being secured to said bra band;

an inner cup for each of said at least one breast cup, said inner cup comprising a curved support member fixedly secured to a bottom of said inner cup and having a first end and a second end, said curved support member being moveably attached at one or more selective locations to said breast cup underwire;

an adjustment clip;

an inner cup support strap for each of said at least one breast cup, a first end of said inner cup support strap being secured to said inner cup, and a second end of said inner cup support strap being secured to said adjustment clip; and wherein a portion of said shoulder strap proximate to its second end is configured to releasably secure a portion of said adjustment clip thereto, at one of two or more distinct locations, to permit at least a selective portion of said inner cup to occupy a desired position from among two or more positions, to permit incremental lift adjustment of a wearer's breast therein.

24. The brassiere according to claim 23 wherein said curved support member being moveably attached to said breast cup comprises:

a head of a first pin being slidably received in a first hollow portion of said underwire, and with an end of a shank of said first pin being distal from said head, being fixedly secured to said curved support member of said inner cup;

a head of a second pin being slidably received in a second hollow portion of said underwire, and with an end of a shank of said second pin being distal from its head, being fixedly secured to said curved support member of said inner cup; and wherein said incremental lift adjustment by said inner cup support strap causes said first and second pin heads to respectively track within said first and second hollow portions of said underwire.

25. The brassiere according to claim 24 wherein said shank of each of said first pin and said second pin comprises an elastic shank portion.

26. The brassiere according to claim 21 further comprising an elastic breast-cup support strap for each of said at least one breast cup, said breast-cup support strap having a first end secured to said means for releasably securing of said second end of said inner cup support strap, said elastic breast-cup support strap having a second end being secured to a top portion of said at least one breast cup.

27. The brassiere according to claim 26 wherein said portion of said inner cup support strap being secured to said inner cup comprises:

said portion of said inner cup support strap between its first and second ends being fixedly secured to a top portion of said inner cup; with said first end of said inner cup support strap fixedly secured to a bottom portion of said at least one breast cup; and wherein at least a portion of said inner cup support strap comprises elastic material, said elastic material being located between said first end of said inner cup support strap and said securement of said inner cup support strap at said top portion of said inner cup.

28. The brassiere according to claim 27, wherein said inner cup comprises a curved support member secured to said bottom of said inner cup, said curved support member configured to be flexible to deform between said first and second ends of said inner cup; and said brassiere further comprising an underwire secured to said bottom portion of said at least one breast cup, said underwire configured to be flexible to deform in response to said deformation of said curved support member of said inner cup.

* * * * *